US008854403B2

(12) United States Patent
Skorokhod et al.

(10) Patent No.: US 8,854,403 B2
(45) Date of Patent: Oct. 7, 2014

(54) IMAGE FORMING APPARATUS WITH A TFT BACKPLANE FOR XEROGRAPHY WITHOUT A LIGHT SOURCE

(75) Inventors: Vladislav Skorokhod, Mississauga (CA); Gregory McGuire, Oakville (CA); Robert A. Street, Palo Alto, CA (US)

(73) Assignee: Xerox Corporation, Norwalk, CT (US)

( * ) Notice: Subject to any disclaimer, the term of this patent is extended or adjusted under 35 U.S.C. 154(b) by 791 days.

(21) Appl. No.: 12/366,680

(22) Filed: Feb. 6, 2009

(65) Prior Publication Data

US 2010/0201777 A1 Aug. 12, 2010

(51) Int. Cl.

| | |
|---|---|
| ***B41J 2/39*** | (2006.01) |
| ***B41J 2/395*** | (2006.01) |
| ***G03G 15/32*** | (2006.01) |

(52) U.S. Cl.
CPC .. *B41J 2/39* (2013.01); *G03G 15/32* (2013.01)
USPC ..... 347/141

(58) Field of Classification Search
CPC ..... G03G 15/0266; G03G 15/1645; G03G 15/80; B41J 2/45; B41J 2/39; B41J 2/395; B41J 2/435; B41J 2/52
USPC ..... 347/141
See application file for complete search history.

(56) References Cited

U.S. PATENT DOCUMENTS

| | | | | |
|---|---|---|---|---|
| 5,426,488 | A * | 6/1995 | Hayakawa et al. | 399/174 |
| 6,100,909 | A | 8/2000 | Haas et al. | |
| 6,195,196 | B1 * | 2/2001 | Kimura et al. | 359/295 |
| 6,780,776 | B1 * | 8/2004 | Qi et al. | 438/706 |
| 2005/0259140 | A1 * | 11/2005 | Kim et al. | 347/140 |

* cited by examiner

*Primary Examiner* — Charlie Peng
*Assistant Examiner* — Erin Chiem
(74) *Attorney, Agent, or Firm* — Fay Sharpe LLP

(57) ABSTRACT

Systems and methods are described that facilitate using TFT control of electronic discharge for surface potential reduction and latent image formation on an imaging member. Corona charging is performed to first create a background surface potential, followed by selective discharge of individual pixels using an array of TFTs to supply free charge carriers to reduce the electrostatic surface potential to nearly zero. This is followed by discharged area development (DAD) to develop the latent image on a print medium (e.g., paper). The described systems and methods do not require a HVPS to drive the backplane; therefore, the TFT matrix is electrostatically decoupled from the developer and other system components in direct contact with the imaging member. Accordingly, known addressing systems may be used to address the TFT array.

12 Claims, 5 Drawing Sheets

IMAGE FORMING APPARATUS WITH A TFT BACKPLANE FOR XEROGRAPHY WITHOUT A LIGHT SOURCE

CROSS-REFERENCE TO RELATED APPLICATIONS

The subject application contains subject matter related to U.S. patent application Ser. No. 12/366,665 entitled "PHOTORECEPTOR WITH A TFT BACKPLANE FOR XEROGRAPHY WITHOUT A ROS SYSTEM," and filed concurrently herewith, the entirety of which is incorporated by reference herein.

BACKGROUND

The subject application relates to latent image formation in xerographic systems. While the systems and methods described herein relate to image formation in xerographic systems, it will be appreciated that the described techniques may find application in other image formation systems, other xerographic applications, and/or other imaging methods.

Approaches to photoreceptor-based xerography have included using high-mobility transport layers, light-absorbing additives, anti-reflective substrates, and addressable LED or LCD light sources.

Classical latent image formation in xerography consists of the following steps: charging the surface of the imaging member (e.g., a photoreceptor) with corona to create background surface potential; photo-generating free charge carriers within the areas that need to be toned; and changing surface potential in these areas by transporting photo-generated charge towards the surface.

In analog or light-lens xerography, using the light reflected from the original image to photo-generate electric charge in a photosensitive imaging member is the conventional way to convert an original image into a latent image. In digital xerography, however, the original image is already digitally encoded, and therefore can be converted into various types of signal. The concept of using light to write a latent image onto a photosensitive imaging member was simply inherited from light-lens xerography, but it is not the only possible way to generate a latent image.

Disadvantages of photoreceptor-based xerography include low charge mobility, sensitivity to light shock, and the need of an expensive light source such as a raster output scanner (ROS) (e.g., a laser) that occupies a considerable space in the system and adds greatly to its cost. Additionally, exposure to a laser beam is associated with various parasitic effects that cause image distortion and limit resolution (see, e.g., Journal of Imaging Sci. and Tech, vol. 40, p. 327, 1996)

U.S. Pat. No. 6,100,909 (Haas and Kubby) describes an apparatus for forming an imaging member comprising an array of high voltage thin-film transistors (TFT) and capacitors. A latent image directly formed by applying appropriate DC bias to the TFT using a high-voltage power supply (HVPS) and charged-area detection (CAD)-type development.

Accordingly, there is an unmet need for systems and/or methods that facilitate using TFT control of electronic discharge for surface potential reduction and latent image formation on an imaging member, while overcoming the aforementioned deficiencies.

BRIEF DESCRIPTION

In accordance with various aspects described herein, systems and methods are described that facilitate using thin-film transistors (TFT) to electronically discharge pixels on a photoreceptor and form a latent image thereon. For example, a method of forming a latent image on a photoreceptor comprises charging a charge-acceptance layer coupled to a thin-film transistor (TFT) array on the photoreceptor, and selectively discharging pixels of the charge-accepting surface by adjusting a voltage across TFTs coupled to the respective pixels. The method further comprises performing a discharged area development (DAD) technique on the TFT array surface to develop the latent image on a print medium.

According to another feature described herein, a system that facilitates forming a latent image on a photoreceptor comprises a thin-film transistor (TFT) array comprising a plurality of TFTs coupled to a ground plane, and a charge acceptance layer deposited over the TFT array. Each TFT corresponds to a pixel the charge acceptance layer. The charge acceptance layer is charged with negative ion. The TFTs have a gate-to-source voltage (Vgs) that is adjustable to discharge respective pixels coupled to the respective TFTs to form a latent image.

Yet another feature relates to a method of forming a latent image on a photoreceptor, without a light source, comprising using thin-film transistors with an adjustable gate-to-source voltage to control electronic discharge of ions from pixel regions on a charge acceptance layer, and developing a latent image formed by discharged pixel regions on the charge acceptance layer using a discharged area development (DAD) technique.

DETAILED DESCRIPTION

In accordance with various features described herein, systems and methods are described that facilitate using a TFT backplane with discharged area development (DAD) for latent image formation (e.g., whereby discharged area(s) on the imaging member surface correspond to an image on a print medium, and charged areas correspond to background). The described systems and methods facilitate forming latent images without the direct coupling of a high-voltage power source (HVPS) to the surface of the imaging member.

The current innovation proposes using corona charging to first create a background surface potential (Vbg) followed by selectively discharging individual pixels by using an array of TFTs to supply free charge carriers to reduce the electrostatic surface potential to nearly zero. This is followed by discharged area development to develop the latent image on a print medium (e.g., paper). An advantage of the described innovation is that it does not require a HVPS to drive the backplane; therefore, the TFT matrix is electrostatically decoupled from the developer and other system components in direct contact with the imaging member. Thus, known addressing systems may be reused in the present innovation.

Figure 1:
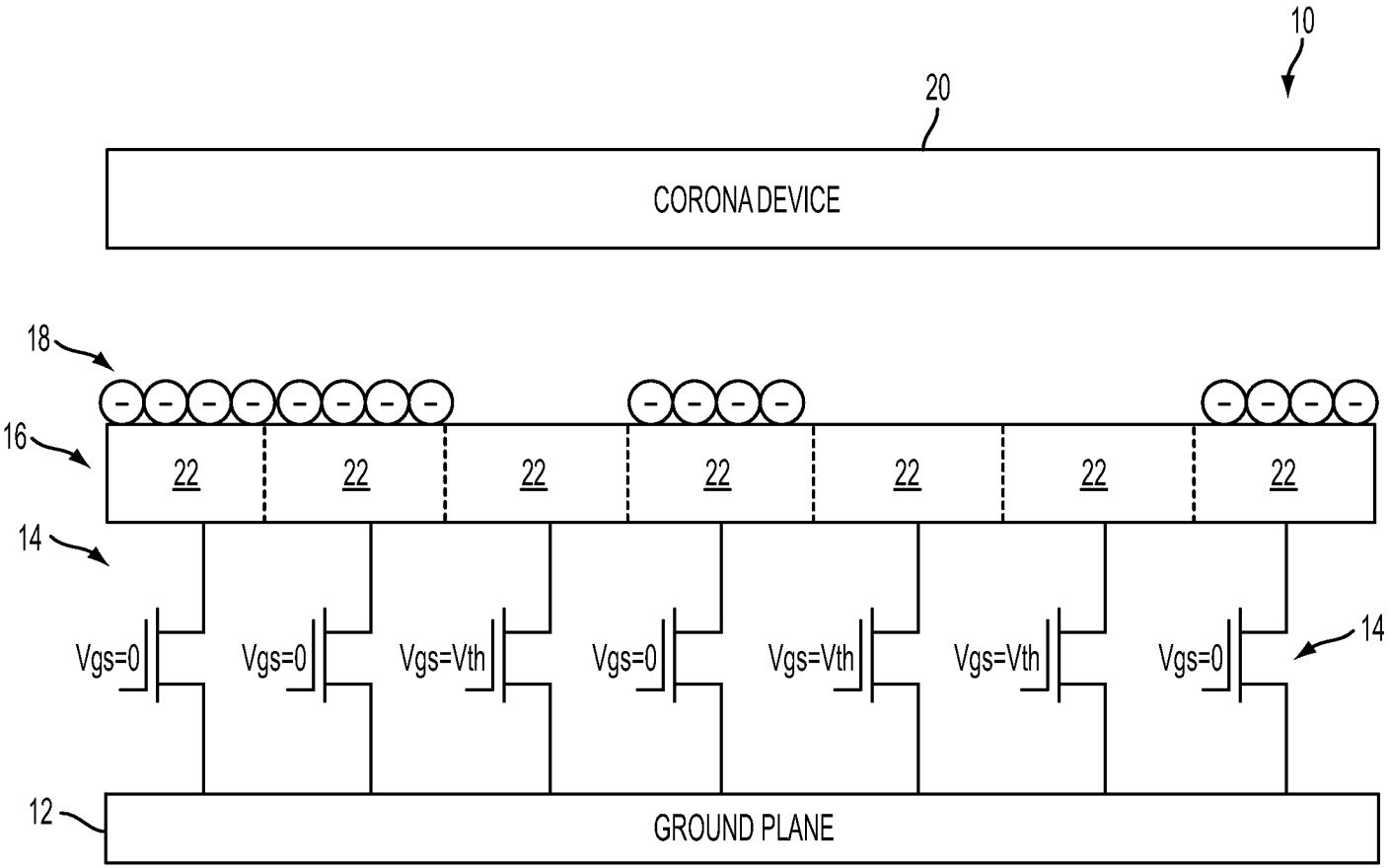
FIG. 1 illustrates a latent image forming system that facilitates latent image formation on a surface of an imaging member using a TFT backplane comprising a plurality of TFTs, which are also coupled to a charge acceptance layer.

With reference to FIG. 1, a latent image forming system 10 is illustrated that facilitates latent image formation on a surface of an imaging member using a TFT backplane comprising a plurality of TFTs 14, with the source electrodes connected to ground plane 12 and drain electrodes coupled to a charge acceptance layer 16 (e.g., a hole transport layer, insulator-conductive filler composite or the like). The system 10 uses TFT control for both electronic discharge for surface potential reduction and for latent image formation. Corona charging is employed to fully charge the charge acceptance layer 16 with charged particles 18. The latent image formation via selective discharge of the surface is controlled by adjusting a voltage across one or more TFTs 14. For instance TFTs with a gate-to-source voltage (Vgs) of 0 will prevent discharging of the surface of the charge acceptance layer 16. Other TFTs with a Vgs greater than a predetermined threshold voltage (Vth) for the TFT will enable a large surface charge by allowing charge of the opposite polarity to flow from the ground plane 12 to the opposite side of the charge acceptance layer 16. The resolution of the latent image is limited only by the manufacturing capability of printed TFTs. For example, the image resolution may be 600 dpi or greater.

The TFTs 14 may be organic or silicon-based, and a photosensitive device and a light source are not required for latent image generation. In one embodiment, each TFT element corresponds to an individual pixel (e.g., an area or region of the charge acceptance layer 16 with a surface area equal to one image pixel).

When forming a latent image, the charge acceptance layer 16 is charged using a corona device 20. In one embodiment, the corona device is a scorotron. A scorotron is a device that charges the charge acceptance layer 16 using one or more corona-producing wires. Between the corona-producing wires and the surface being e charged is a grid of wires. The corona emitting wires are maintained at a high voltage that maintains the wire grid at a desired surface-charging potential. Initially, the charge acceptance layer has a potential lower than desired, causing corona current to pass through the wire grid to the charge acceptance layer. When the charge acceptance layer potential and the wire grid potential are equal, corona current flow to the charge acceptance layer is terminated.

Corona current is current that flows towards a corona wire when the wire is maintained at a high potential relative to ground (e.g., a corona threshold voltage, Vth). Gas molecules (e.g., air) around the wire are ionized by the high potential, and the electrons move towards the corona wire, colliding with other gas molecules along the way to cause additional ionization. The ionized gas molecules flow away from the corona wire and form a positive current that is used to charge the charge acceptance layer 16. Vth is the voltage at or above which a corona appears around the corona wire, due to gas molecule ionization.

The charge acceptance layer 16 creates a background potential (Vbg) as well as a bias between the drain and source (ground) electrodes of the TFTs. The areas that need to be toned are discharged by supplying free charge carriers (holes) as is done in traditional xerography, except that instead of photogeneration, a Vgs>Vth is applied to the appropriate TFT elements, while Vgs=0 is applied to the TFTs within the background areas.

The proposed concept offers the following advantages over traditional photoreceptor xerography which are shown in Table 1: an exposure step and a need for a ROS are eliminated, therefore making the imaging process more reliable with less noise and fewer limiting factors for resolution; elimination of the ROS system allows for a more compact design; the imaging member is a digital device with a fixed resolution; the system 10 is stable to light shock; and long term cost advantage.

TABLE 1

Advantages of the system 10 over the traditional photoreceptor-based technology

| Photoreceptor | TFT imaging member |
|---|---|
| Requires a light source | Does not require a light source |
| Analog device | Digital device |
| Resolution limited by dielectric thickness and depends on ROS | Resolution is limited only by the planar integration density |
| Light-sensitive | Not light-sensitive, therefore easier handling |
| Mobility $10^{-4}$ $cm^2/V * s$ | Mobility 0.1-1.0 $cm^2/V * s$ |

In one embodiment, the TFTs 14 have a 1:1 ratio with pixels electrodes 22 on the charge acceptance layer 16 (e.g., each pixel has a dedicated TFT to control whether it is charged or discharged). In another example, the TFTs have a ratio greater than 1:1 with the pixels 22, for enhanced resolution.

Figure 2:
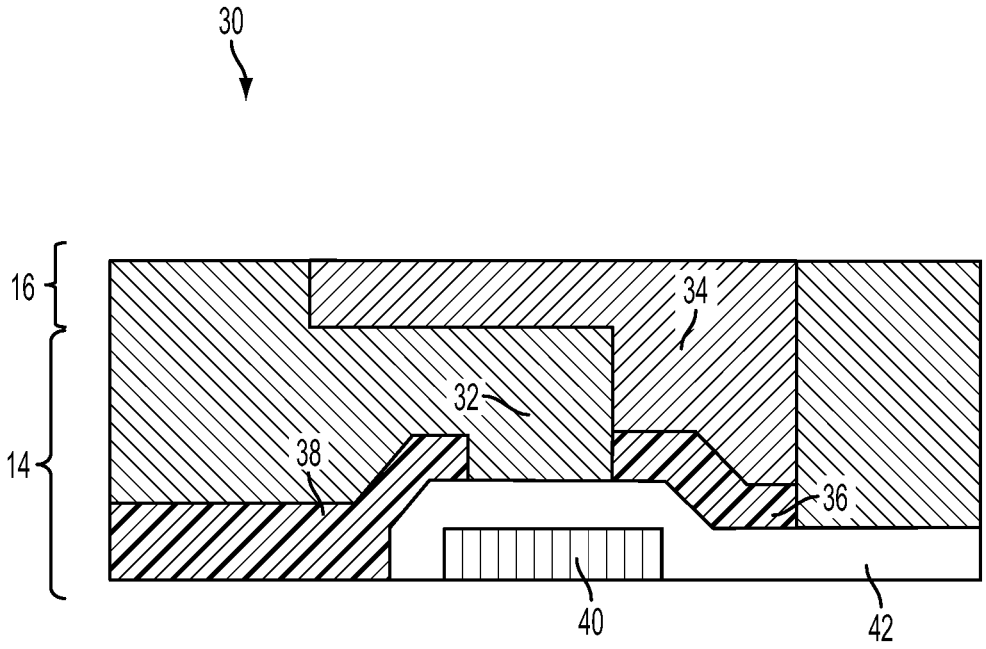
FIG. 2 illustrates a cross-section view of a single pixel of a TFT backplane device, which includes a TFT and a ground plane, in accordance with various aspects described herein.

FIG. 2 illustrates a cross-section view of a single pixel of a TFT backplane 30 device, which includes a TFT 14 shown in FIG. 1, in accordance with various aspects described herein. The TFT backplane 30 includes a TFT 14 that comprises semiconductor material 32 (e.g., organic or inorganic) and polymer-filler composite 34 that is coupled to a drain electrode 36 that serves as, or in conjunction with, a charge acceptance layer 16 for the imaging member. A source 38 is permanently connected to a ground electrode 12 (see FIG. 1). To tone a pixel, a voltage (Vgs) is applied to a gate electrode 40 by addressing it from the inner side of the device, supplying a current to reduce surface electrostatic potential to nearly zero. The gate electrode 40 is coupled to the data driver (see FIG. 3) and to a gate dielectric layer 42, which in turn is coupled to the remainder of the TFT 14 (e.g., the drain 36 electrode, source or ground electrode 38, and the semiconductor material 32).

In one embodiment, the drain 36 is electrostatically coupled to the surface of a scorotron (not shown) used to charge the charge acceptance layer of the imaging member on which the TFT backplane device 30 is employed, in order to supply charge thereto. In another embodiment, a biased roll charging device (not shown) is used to charge the charge acceptance layer, such as is known by those of skill. Opening the transistor lets charge flow through the TFT to cancel charge from the scorotron, causing the expulsion of ions therefrom (e.g., discharge).

The TFT backplane section shown in FIG. 2 is based on horizontal TFT. Additionally or alternatively, a vertical TFT design can be used. A guard electrode (not shown) may be introduced to prevent cross-talk between the TFT elements.

According to an example, substrate (e.g., ground plane 16) is provided with an array of TFTs 14. To form the TFTs, amorphous silicon transistors are made by photolithography with a sputtered metal gate contact 40 followed by a silicon nitride gate dielectric 42 and an amorphous silicon channel, both deposited by plasma-enhanced chemical vapor deposition (CVD). This is followed by n-type doped amorphous silicon for the source contact 38 and drain contact 36, and then a metal interconnect layer. A silicon oxynitride passivation may be formed layer over the top of the TFT. The source column electrodes are connected to a common ground and to gate electrodes connected to a gate driver. The drain electrodes 36 act as a high resolution switchable ground plane for the imaging member. Upon the drain electrodes, a hole transport layer (not shown) is deposited. The hole transport layer may be similar or identical to the charge acceptance layer 16 of FIG. 1. The hole transport layer comprises 50% N,N'-diphenyl-N,N-bis(3-methylphenyl)-1,1'-biphenyl-4,4'-diamine and 50% Makrolon and is 15% solids in $CH_2CL_2$. The layer is deposited using common solution web coating methods and dried in a forced air oven at, for example, 100° C. for 5 minutes.

Figure 4:
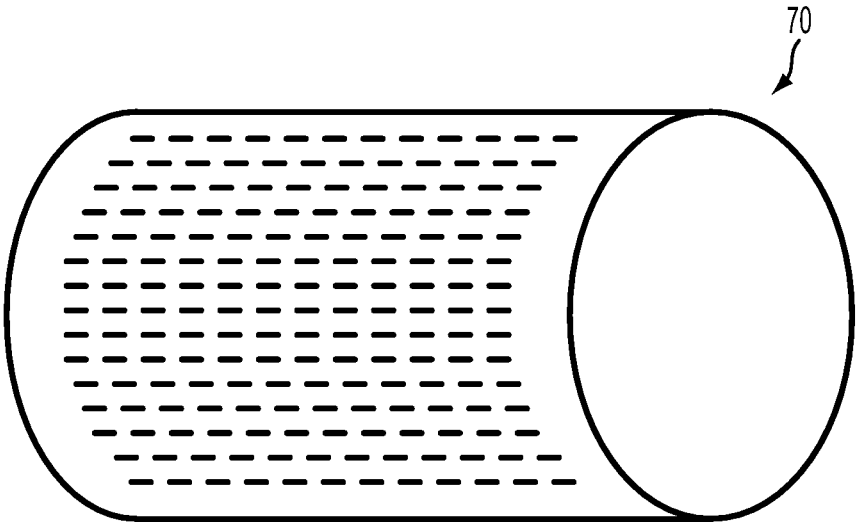
FIGS. 4 and 5 illustrate a latent image of surface charge using conventional row-by-row addressing of pixels to create the latent image of surface charge.

All TFTs 14 are switched "off" by applying Vgs=0 to gate electrodes 40, which causes the drain electrodes 36 to be floating. A scorotron device is then used to charge the surface of the device to a predetermined potential (FIG. 4). Then, selected TFTs under areas to be toned are switched "on" by applying Vgs>Vth to gate electrodes 38, which causes the surface potential to drop to nearly zero in those selected areas. In this manner, a latent image is formed on the surface of the imaging member and is ready to be toned.

According to another example, the TFTs described herein operate at a threshold voltage (Vth) of approximately 40V. TFTs are modified to withstand several hundred Volts (e.g., 200V-800V, in one example), while operating at 40V, by spacing the drain 36 and source 38 so that voltage is attenuated and the applied voltage is approximately 40V.

Figure 3:
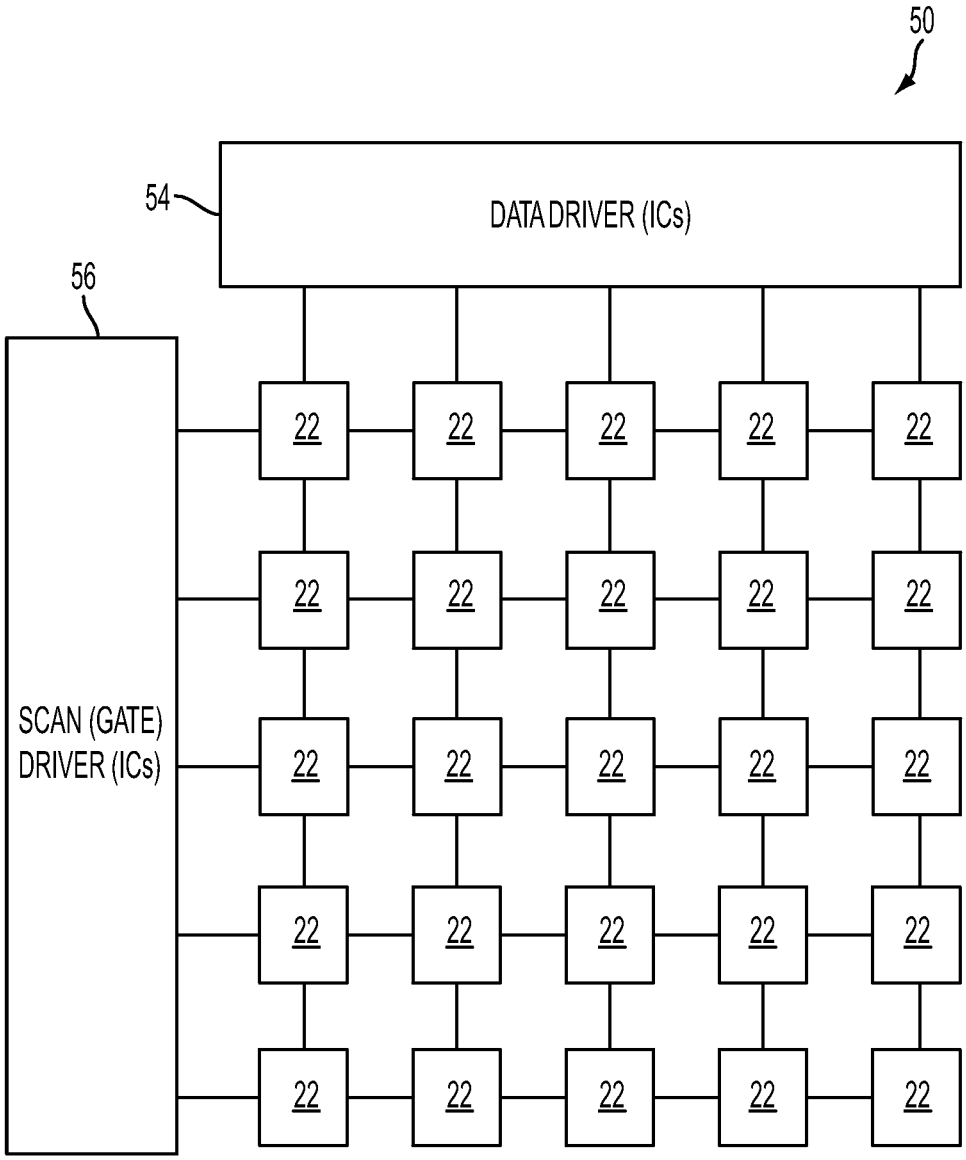
FIG. 3 illustrates an array of pixel electrodes that uses an active matrix driving scheme in which a plurality of pixel electrodes are each connected to a switching device (TFT) as described herein.

FIG. 3 illustrates an array 50 of pixel electrodes 22 (also called a TFT array herein) that uses an active matrix driving scheme in which a plurality of pixel electrodes are each connected to a switching device (TFT) as described herein. An active substrate of an imaging device employing the array 50 contains a plurality of column (data) electrodes that are coupled to a data driver 54 (e.g., one or more integrated circuits or ICs), limited by the number of pixels 22 per row, and a plurality of row (scan) electrodes coupled to a scan driver 56 (e.g., one or more ICs), limited by the number of pixels per column. The scan electrodes control the gates of respective TFTs. Each switching TFT (coupled to the respective pixel electrodes) has a control (gate) terminal connected to the scan electrode, an input (source) terminal connected to the data electrode and an output (drain) terminal connected to a charge acceptance layer of the photoreceptor.

In one embodiment, two TFTs are provided per pixel, where a first TFT controls the gate of a second TFT to address a row of pixels (e.g., to hold the pixels open). A pattern on "ON" and/or "OFF" TFTs is written line by line.

According to an example, select voltages are applied to the gates of a first row of the TFTs while non-select voltages are applied to the TFT gates in all other pixel rows. Data voltages are applied at the same time to all of the column electrodes to discharge each pixel in the selected row to zero surface potential. The select voltage applied to the gates in the first row of TFTs is charged to a non-select voltage. This sequence is repeated for each succeeding row until all of the rows have been selected and the desired pixels have been discharged to form a latent image on the imaging device surface. After discharge area development, select voltages are applied to all row (gate) electrodes simultaneously to clear the latent image 72.

In another embodiment, to operate in a continuous mode with development and erase, a dual scanning mode may be implemented. The array 50 is divided into two equal halves, and separate data and scan drivers are used for each of the two half-arrays. When one half of the array is completely past the discharge area development stage, that half-array can be activated all at once to clear the partial latent image. Concurrently, the other half array can begin addressing its pixels to form the remainder of the latent image. This process can be repeated to obtain continuous mode printing.

Figure 5:
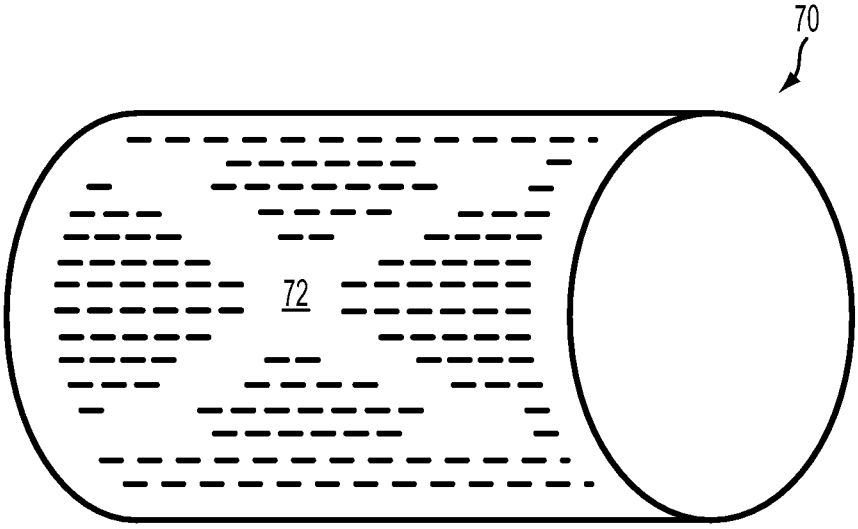

FIGS. 4 and 5 illustrate a latent image of surface charge using conventional row-by-row addressing of pixels to create the latent image of surface charge. In FIG. 4, an imaging member 70 having a layer of the TFT backplane described herein that is charged using a scorotron (not shown) or the like. In FIG. 5, a latent image 72 is formed on the imaging member by discharging areas corresponding to the latent image 72. For instance, individual pixels are addressed row-by-row to form the latent image 72, followed by discharge area development.

Figure 6:
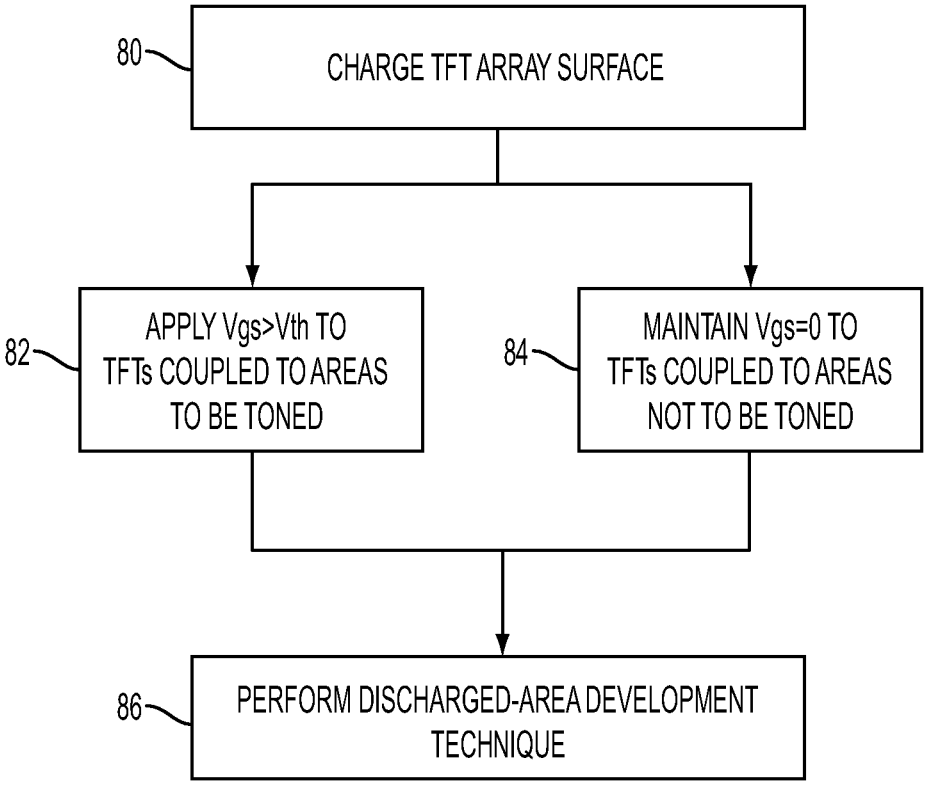
FIG. 6 illustrates a method of latent image formation, in accordance with various aspects presented herein.

FIG. 6 illustrates a method of latent image formation, in accordance with various aspects presented herein. At 80, a charge acceptance layer of a TFT array is charged using a corona device. The surface charge layer creates a background potential (Vbg) as well as a bias between the drain and source (ground) electrodes. At 82, areas to be toned (e.g., to which toner is to adhere) are discharged by supplying free charge carriers (holes) by applying gate-to-source voltage Vgs that is greater than Vth to the appropriate TFT elements. Concurrently, at 84, a voltage Vgs=0 is maintained for the TFTs within the background areas (e.g., areas not to be toned). At 86, a discharge area development technique is performed to develop a physical image from the latent image.

According to an example, a production photoreceptor comprising a mylar substrate, a TiZr metalized layer on top of the substrate, and a N,N'-diphenyl-N,N-bis(3-methylphenyl)-1,1'-biphenyl-4,4'-diamine and 50% Makrolon™ charge transport layer (e.g., the charge acceptance layer 16 of FIG. 1) is overlaid on top of a photo-generating layer. The metalized TiZr backplane is switched between grounded and floating states. The device was then charged with, for instance, a 4200 Volt Scorotron, and surface charge may be measured with a capacitance probe. In this example, the charge acceptance layer shows a high level of charge acceptance when the backplane is floating. When the backplane is subsequently grounded, 90% discharge occurs. Thus, a TFT-switchable ground plane, such as is described herein with regard to the various described embodiments, facilitates inducing selective electronic discharge of the surface potential, and latent image formation.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A system that facilitates forming a latent image on a photoreceptor, comprising:

a thin-film transistor (TFT) array comprising a plurality of TFTs located above and coupled to a ground plane; and a charge acceptance layer deposited over the TFT array;

wherein each TFT corresponds to a pixel of the charge acceptance layer;

wherein the charge acceptance layer is charged with negative ions;

wherein the TFTs have a gate-to-source voltage (Vgs) configured to be adjusted to reduce a surface voltage of respective pixels coupled to the respective TFTs to form a latent image;

wherein the gate-to-source voltage (Vgs) is applied to a gate electrode of respective TFTs by addressing the gate electrode from the inner side of the TFT; and wherein one or more pixels is discharged to form a latent image on the charge acceptance layer, without a light source, by adjusting the gate-to-source voltage (Vgs) of one or more TFTs corresponding to the one or more pixels such that Vgs is greater than a predetermined threshold voltage (Vth), and wherein the TFTs are configured to withstand a range of approximately 200V to 800V, while operating at the predetermined threshold voltage, by spacing a drain and a source of the TFTs so as to attenuate the applied gate-to-source voltage (Vgs) down to the predetermined threshold voltage (Vth).

2. The system of claim 1, further comprising a data driver that is coupled to a plurality of data electrodes, wherein each data electrode is coupled to source terminals on a plurality of TFTs in a respective column of the TFT array.

3. The system of claim 2, further comprising a scan driver that is coupled to a plurality of scan electrodes, wherein each scan electrode is coupled to gate terminals on a plurality of TFTs in a respective row of the TFT array.

4. The system of claim 3, wherein the charge acceptance layer is coupled to a drain terminal on the TFTs in the array.

5. The system of claim 1, further comprising at least one of a scorotron and a biased roll charging device that charges the charge acceptance layer.

6. The system of claim 5, wherein the TFTs have a gate-to-source voltage (Vgs) of 0V when the pixels are charged.

7. The system of claim 6, wherein the predetermined threshold voltage is approximately 40V.

8. The system of claim 1, wherein the charge acceptance layer comprises N,N'-diphenyl-N,N-bis(3-methylphenyl)-1,1'-biphenyl-4,4'-diamine and Makrolon™ in a ratio of approximately 2:3 to approximately 3:2.

9. The system of claim 8, wherein the charge acceptance layer is deposited on the TFT array using a solution web coating method, and dried in a forced air oven at approximately 100° C. for approximately 5 minutes.

10. The system of claim 1, wherein the charge acceptance layer comprises N,N'-diphenyl-N,N-bis(3-methylphenyl)-1,1'-biphenyl-4,4'-diamine and Makrolon™ in a ratio of approximately 1:1.

11. The system of claim 1, wherein the latent image is developed using a discharged area development (DAD) technique.

12. The system of claim 1, wherein the ratio of TFTs to pixels is 1:1.

* * * * *